US009564699B1

(12) United States Patent
Ma

(10) Patent No.: US 9,564,699 B1
(45) Date of Patent: Feb. 7, 2017

(54) ELECTRONIC DEVICE WITH SUPPORT MEMBER

(71) Applicants: NANNING FUGUI PRECISION INDUSTRIAL CO., LTD., Nanning (CN); HON HAI PRECISION INDUSTRY CO., LTD., New Taipei (TW)

(72) Inventor: Cheng-Hua Ma, New Taipei (TW)

(73) Assignees: NANNING FUGUI PRECISION INDUSTRIAL CO., LTD., Nanning (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/969,808

(22) Filed: Dec. 15, 2015

(30) Foreign Application Priority Data

Nov. 30, 2015 (TW) ..... 104140006 A

(51) Int. Cl.
*H01R 31/08* (2006.01)
*H01R 12/70* (2011.01)

(52) U.S. Cl.
CPC ..... *H01R 12/7076* (2013.01)

(58) Field of Classification Search
CPC ..... H01R 31/08
USPC ..... 439/509, 508, 510, 911, 952; 340/5.31
See application file for complete search history.

(56) References Cited

U.S. PATENT DOCUMENTS 4,091,246 A * 5/1978 Donofrio ..... H01R 13/707 200/50.28
4,494,143 A * 1/1985 Lovick ..... G07F 17/0014 200/51.09
4,547,767 A * 10/1985 Steele ..... G08B 23/00 340/500
4,945,872 A * 8/1990 Embry ..... B60R 25/045 123/146.5 B
5,212,729 A * 5/1993 Schafer ..... G06F 21/34 439/628
5,321,203 A * 6/1994 Goto ..... B61D 29/00 174/489
5,938,472 A * 8/1999 Yuen ..... H01H 3/16 439/509
7,113,103 B2 * 9/2006 Festa ..... G08B 29/046 340/568.1

(Continued)

*Primary Examiner* — Neil Abrams
(74) *Attorney, Agent, or Firm* — Zhigang Ma

(57) ABSTRACT

An electronic device includes at least one cover, a shell removably coupled to the cover, a circuit board, a support member, and a plurality of connectors. The circuit board is received between the cover and the shell, and a plurality of groups signal terminals are mounted on the circuit board. The support member is mounted on the circuit board and coupled to the cover, and the support member defines a slanted portion. The plurality of connectors are located on the slanted portion and include a plurality of first type connectors and a plurality of second type connectors coupled to the corresponding plurality of the groups of signal terminals through the support member and positioned in a proper order. When the cover is detached from the shell, the plurality of first type connectors and second type connectors slide down along the slanted portion, fall off the slanted portion and become mixed up. An unauthorized user might not be able to replace them in the proper order and therefor tampering may be prevented.

10 Claims, 8 Drawing Sheets

(56) References Cited

U.S. PATENT DOCUMENTS 8,169,297 B2 * 5/2012 Peng ..... G05B 19/0428 206/459.1
8,279,075 B2 * 10/2012 Fleischman ..... G06F 21/86 340/652
9,271,410 B2 * 2/2016 Lin ..... H05K 5/0208

* cited by examiner

ELECTRONIC DEVICE WITH SUPPORT MEMBER

FIELD

The subject matter herein generally relates to an electronic device, and particularly relates to an electronic device with a support member preventing information from being stolen or tampered.

BACKGROUND

Unauthorized users can disassemble and jailbreak the electronic device through getting a connection between connectors and signal terminals. Therefore, the electronic devices can be restarted and information in the electronic devices can be stolen or tampered.

BRIEF DESCRIPTION OF THE DRAWINGS

Implementations of the present technology will now be described, by way of example only, with reference to the attached figures.

DETAILED DESCRIPTION

Figure 1:
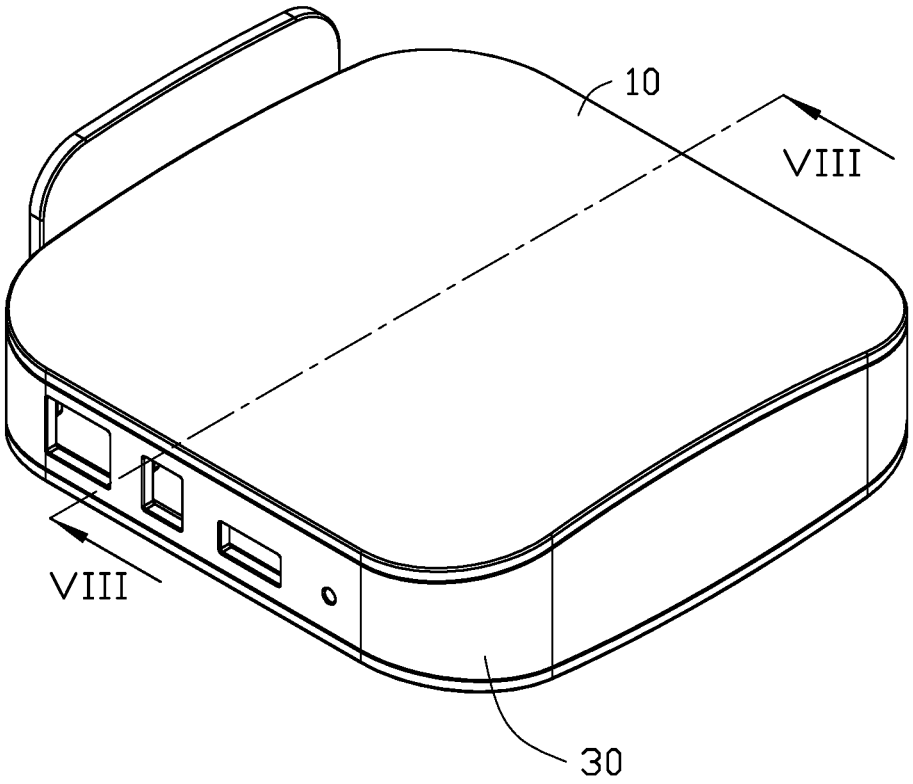
FIG. 1 is an assembled, isometric view of an exemplary embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure relates to an electronic device.

Figure 2:
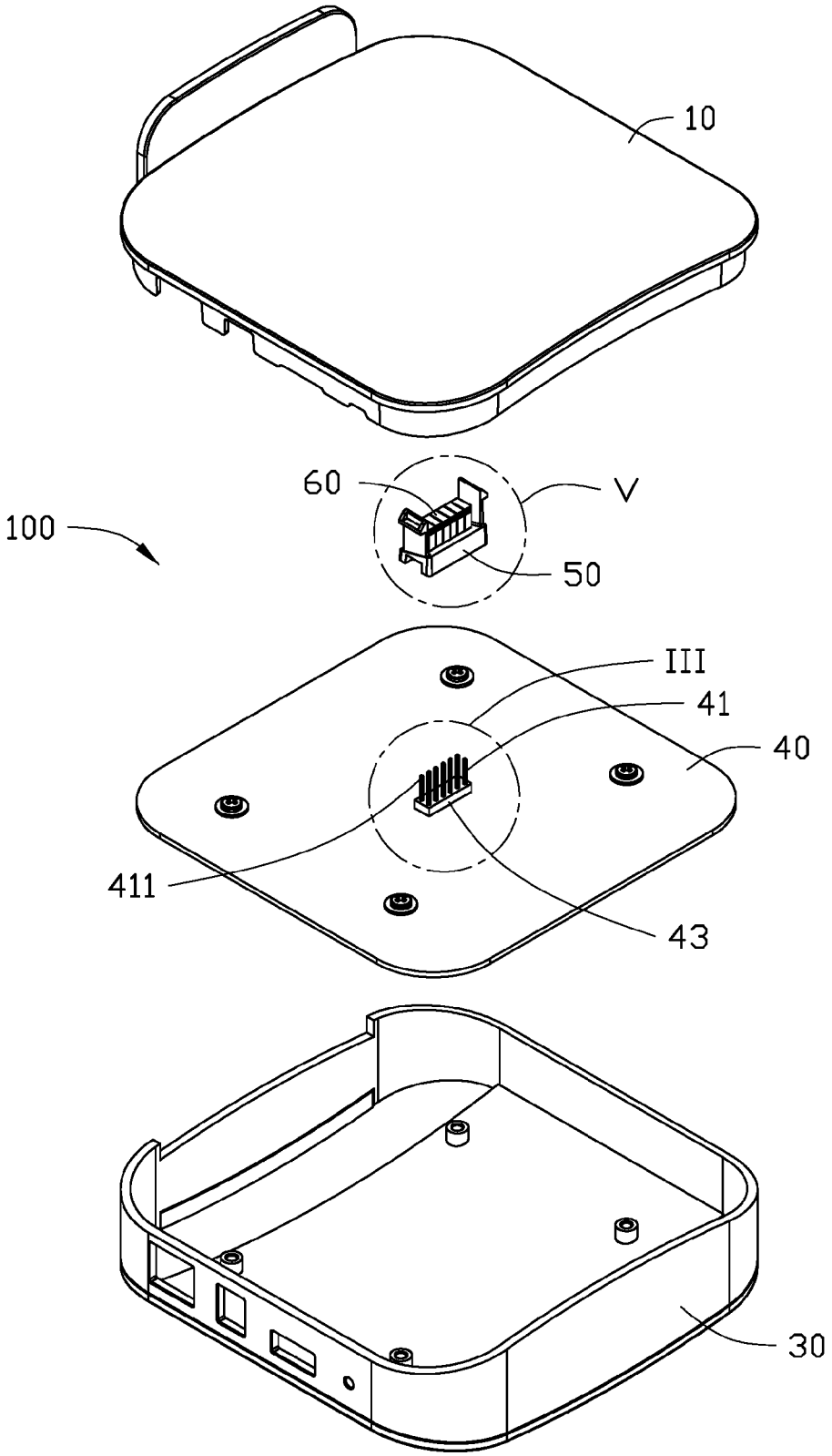
FIG. 2 is an exploded, isometric view of the electronic device of FIG. 1, wherein the electronic device comprises a support member.

FIG. 1 and FIG. 2 illustrate an exemplary embodiment of an electronic device. The electronic device 100 comprises a cover 10, a shell 30, a circuit board 40 mounted on a bottom wall of the shell 30, a support member 50 mounted on the circuit board 40, and a plurality of connectors 60 located on the support member 50.

Figure 3:
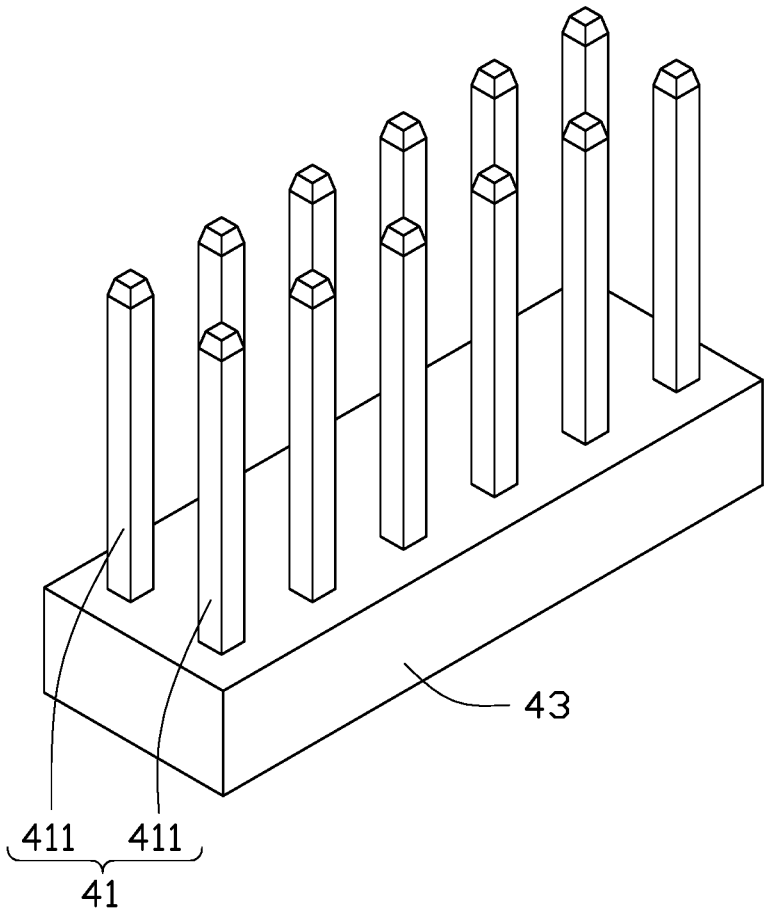
FIG. 3 is an enlarged view of II of FIG. 2.

FIG. 3 illustrates the connectors. The circuit board 40 is mounted on the bottom wall of the shell 30, and a plurality of groups of signal terminals 41 are arranged on the circuit board 40 in an array. Each group of signal terminals 41 comprises two conductive terminals 411. A positioning block 43 protrudes from the circuit board 40, and the signal terminals 41 are mounted in the positioning block 43 and are electrically coupled to the circuit board 40.

Figure 4:
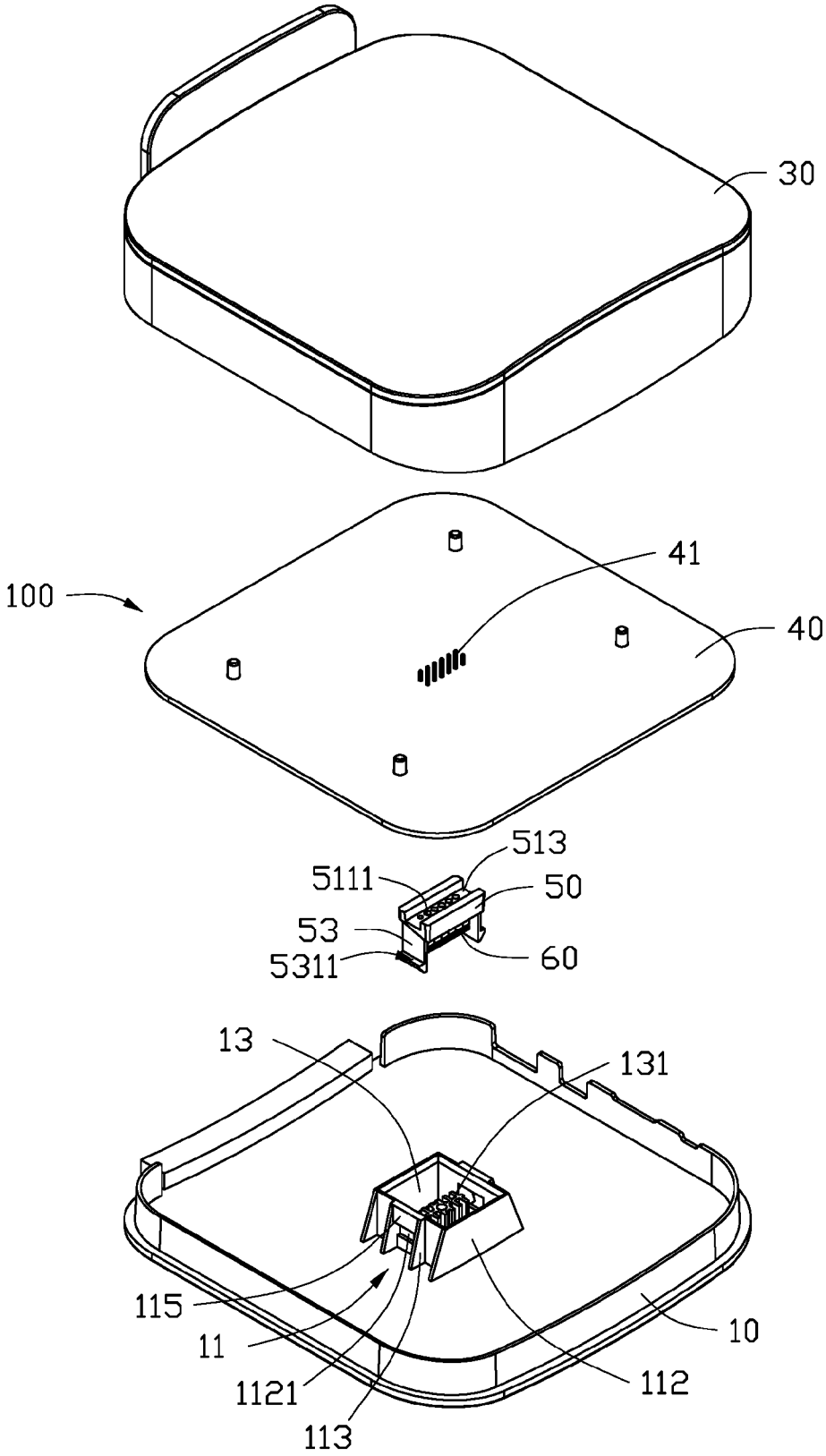
FIG. 4 is an exploded view of the electronic device, but viewed from another angle of FIG. 2.

FIG. 4 illustrates an exploded view of the electronic device, but viewed from another aspect. A shelter 11 is coupled to an inside of the at least one cover 10, and the shelter 11 comprises four fixed plates 112 vertically extending from the inside of the cover 10. The four fixed plates 112 cooperatively define a square receiving space 13. The two opposite fixed plates 112 of the four fixed plates 112 respectively define a rectangular opening 1121, and two ribs 113 are coupled to two sides of each of the openings 1121. A block 115 protrudes from one side of each opening 1121, and adjacent to an opening of the receiving space 13. An abutting portion 131 is mounted in a middle portion of the receiving space 13.

Figure 5:
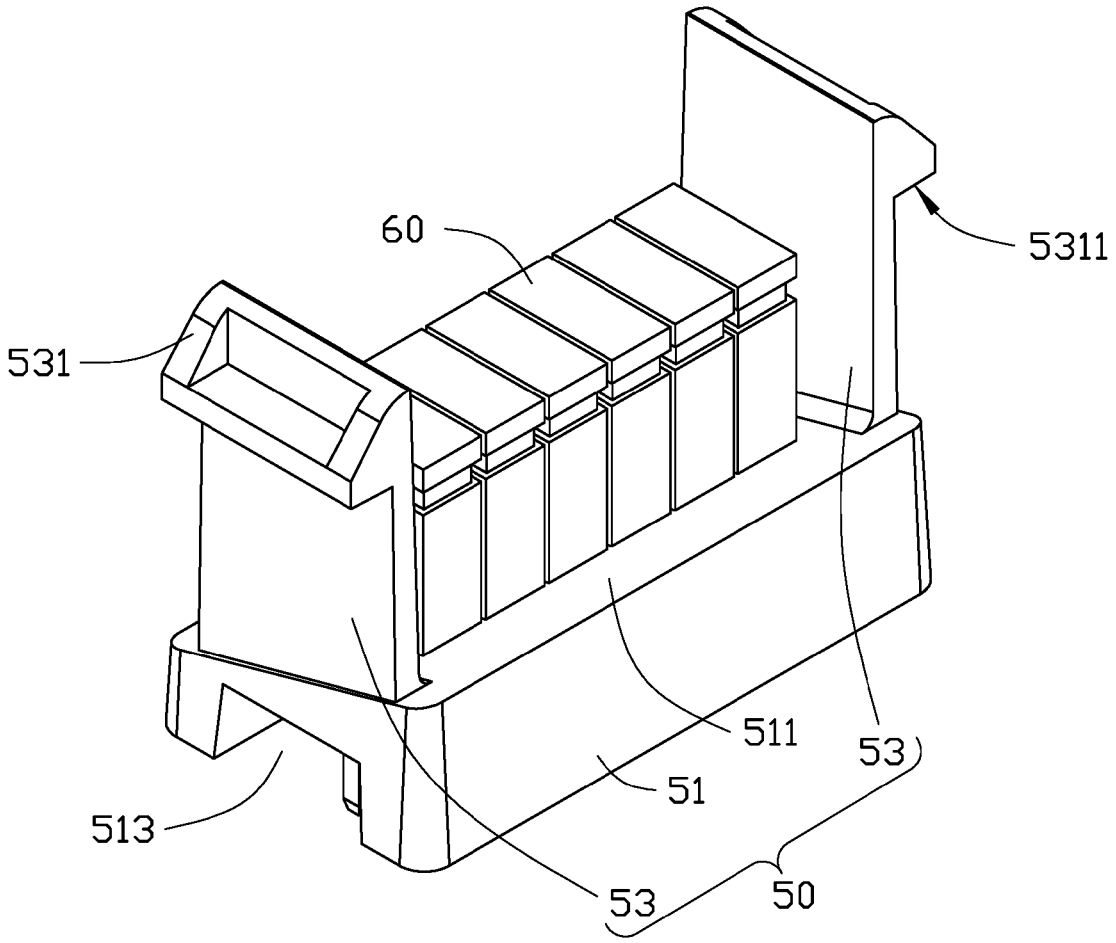
FIG. 5 is enlarged view of V of FIG. 2.
Figure 6:
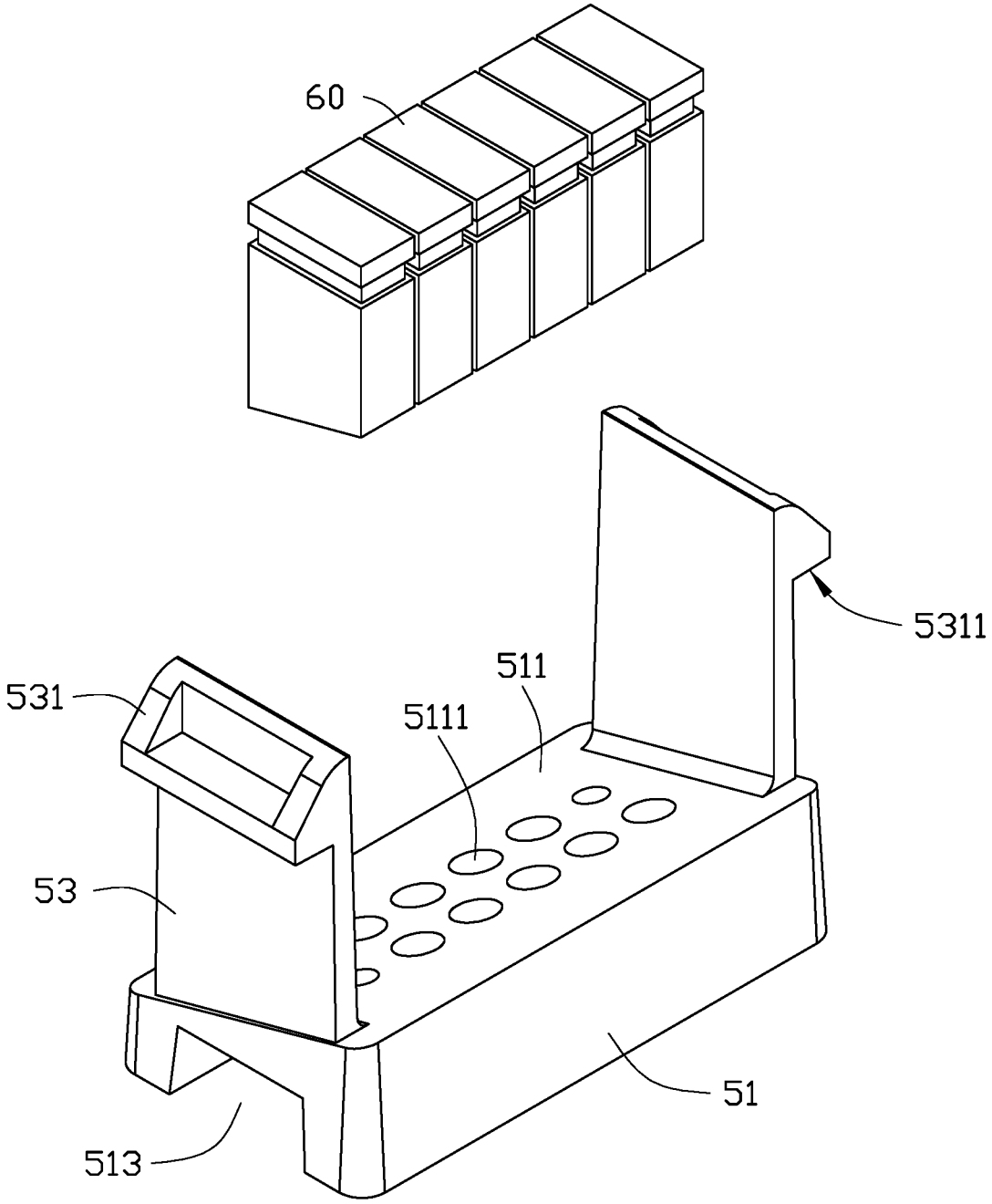
FIG. 6 is an exploded, isometric view of the support member of FIG. 5.

FIGS. 5 and 6 illustrate a support member. The support member 50 comprise a base 51 and two connecting pieces 53 extending up from two sides of the base 51. A top surface of the base 51 defines a slanted portioned portion 511. A bottom side of the base 51 defines a groove 513. The slanted portion 511 defines a plurality of through holes 5111 arranged in an array and connected to the groove 513. A locking portion 531 protrudes from a peak of each of the connecting pieces 53. Each of the locking portions 531 comprises an abutting surface 5311.

Figure 7:
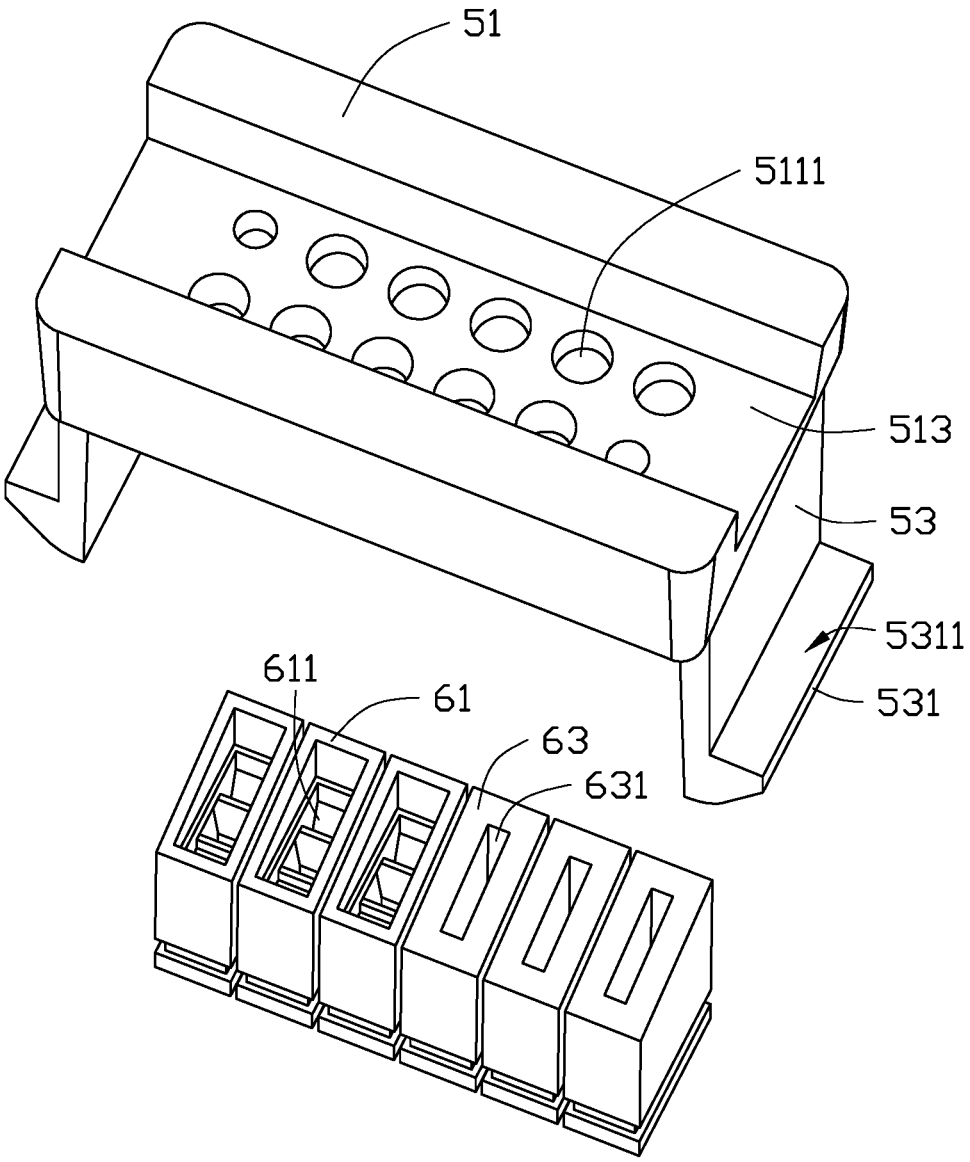
FIG. 7 is an exploded, isometric view of the support member of FIG. 6 viewed from a different angle.

FIG. 7 illustrates a plurality of connectors. The plurality of the connectors 60 comprises a plurality of first type connectors 61 and a plurality of second type connectors 63. Each of the first type connectors 61 defines two slots 611 to receive the conductive terminals 411, and each of the second type connectors 63 defines a slot 631 to receive the conductive terminals 411. The first type connectors 61 and the second type connectors 63 can be coupled to the conductive terminals 411. At least one embodiment, the first type connectors 61 are conductive jumpers, and the second type connectors 63 are insulating jumpers.

Figure 8:
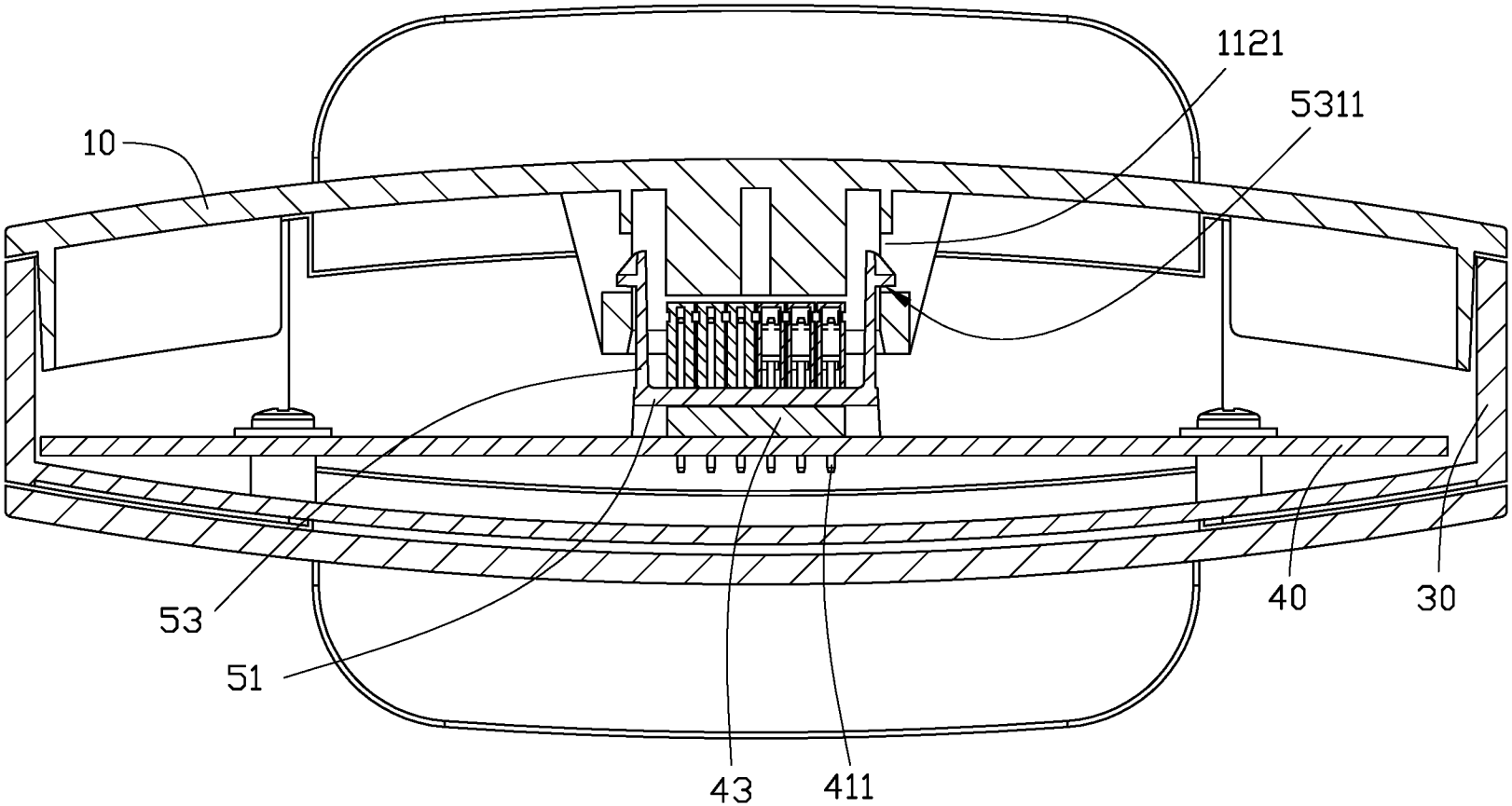
FIG. 8 is a sectional view taken along line VIII of FIG. 1.

FIG. 8 illustrates an assembled view of the electronic device. In assembly of the electronic device 100, the through holes 5111 of the base 51 are opposite to the corresponding conductive terminals 411 of the circuit board 40, and the groove 513 is opposite to the positioning block 43 of the circuit board 40. The support member 50 is moved towards the circuit board 40, and the conductive terminals 411 across the through holes 5111 and the positioning block 43 is locked in the groove 513. The first type connectors 61 and the second type connectors 63 are arranged in any order, and opposite to the corresponding signal terminals 41. The slots 611 of each first type connector 61 and the slot 631 of each second type connector 63 are opposite to corresponding signal terminals 41, the first type connectors 61 and the second type connectors 63 are moved towards the signal terminals 41. The signal terminals 41 are inserted into the slots 611 and 631, and the signal terminals 41 and the first type connectors 61 and the second type connectors 63 arranged in any order cooperatively form a first sequence signal. The first sequence signal can make the electronic device 100 work normally, and is stored in a memory (not shown in FIG) of the circuit board 40. At least one embodiment, the conductive terminals 411 coupled to the first type connectors 61 can produce a conductive signal signed "1", and the conductive terminals 411 coupled to the second type connectors 63 do not produce conductive signal signed "0". The first sequence signal can be formed by arranging the signal "1" and the signal "0" in any order to increase difficulty.

The first type connectors 61 and the second type connector 63 are located on the slanted portion 511 of the support member 50. The connectors 60 are mounted to the support member 50 and the support member 50 is mounted to the circuit board 40. The cover 10 is located on the shell 30, and the receiving space 13 of the shelter 11 is opposite to the support member 50. The cover 10 is moved towards the shell 30, and the locking portions 531 are locked to the openings 1121. The blocks 115 of the shelter abut the abutting surfaces 5311 of the locking portions 531. The cover 10 is mounted to the shell 30, and the support member 50 is received in the receiving space 13 and is sheltered by the shelter 11. The first type connectors 61 and the second type connectors 63 are arranged in a plurality of different order, to form a plurality of different sequence signal. At least one embodiment, the authorized users of the electronic device 100 can change quantity and order of the first type connectors 61 and the second type connectors 63 to define the first sequence signal based on need.

When the cover 10 is detached from the shell 30 by the unauthorized users, the support member 50 is detached from the shell 30 with the cover 10. The conductive terminals 411 are detached from the first type connectors 61 and the second type connectors 63 with the support member 50, and the first type connectors 61 and the second type connectors 63 located on the support member 50 slide down along the slanted portion 511. Therefore, the unauthorized users do not know the initial location of the first type connectors 61 and the second type connectors 63. When the unauthorized users place the first type connectors 61 and the second type connectors 63 on the support member 50 again and mount the cover 10 on the shell 30, the order of the first type connectors 61 and the second type connectors 63 may be different from the initial location of the first type connectors 61 and the second type connectors 63. The circuit board 40 forms a second sequence signal. It is a high probability the first sequence signal and the second sequence signal are different. When a system of the circuit board 40 detects the second sequence signal is different from the first sequence signal, the system will shut down, and the unauthorized users cannot use the system, thus, preventing tampering with the electronic device 100.

The embodiments shown and described above are only examples. Even though numerous characteristics and advantages of the present technology have been set forth in the foregoing description, together with details of the structure and function of the present disclosure, the disclosure is illustrative only, and changes may be made in the details, including matters of shape, size, and arrangement of the parts within the principles of the present disclosure, up to and including the full extent established by the broad general meaning of the terms used in the claims.

What is claimed is:

1. An electronic device comprising:

at least one cover;

a shell removably coupled to the at least one cover;

a circuit board received between the at least one cover and the shell;

a plurality of groups of signal terminals mounted on the circuit board;

a support member mounted on the circuit board and coupled to the at least one cover, the support member having a slanted portioned portion; and a plurality of connectors located on the slanted portioned portion of the support member and comprising a plurality of first type connectors and a plurality of second type connectors coupled to the corresponding plurality of groups of signal terminals through the support member, the plurality of connectors and the plurality of groups of signal terminals coupled to the plurality of connectors producing a first sequence signal, and the first sequence signal controlling the electronic device working on;

wherein in event that the at least one cover is detached from the shell, the support member, the plurality of first type connectors and second type connectors are detached from the corresponding plurality of groups of signal terminals, and the plurality of first type connectors and second type connectors slide down along the slanted portion.

2. The electronic device of claim 1, wherein the support member comprises a base and two connecting pieces extending up from two sides of the base, the slanted portion is defined on a top surface, and the two connecting pieces are locked to the cover.

3. The electronic device of claim 2, wherein a shelter is coupled to an inside of the at least one cover, the shelter comprises four fixed plates extending from the inside of the cover, and the four fixed plates cooperatively define a square receiving space to receive the support member.

4. The electronic device of claim 3, wherein a locking portion protrudes from a peak of each of the connecting pieces, the two opposite fixed plates of the four fixed plates respectively define an opening to lock the locking portion.

5. The electronic device of claim 4, wherein each of the locking portions comprises an abutting surface, a block protrudes from one side of each opening and is adjacent to an opening of the receiving space, and the block abuts the abutting surface.

6. The electronic device of claim 3, wherein an abutting portion is mounted in a middle portion of the receiving space, and the abutting portion abuts the connectors.

7. The electronic device of claim 2, wherein a positioning block protrudes from the circuit board, a bottom side of the base defines a groove to receive the positioning block, the plurality of groups of signal terminals are mounted to the positioning block, and when the cover is detached from the shell, the positioning block is detached from the groove.

8. The electronic device of claim 7, wherein the slanted portion defines a plurality of through holes connected to the groove, each group of the signal terminals across the corresponding through holes and are received in the corresponding connectors.

9. The electronic device of claim 1, wherein each group of signal terminal comprises two conductive terminals, each of the first type connectors defines two slots to receive the conductive terminals, each of the second type connectors defines a slot to receive the conductive terminals, and when the cover is detached from the shell, the conductive terminals are detached from the corresponding slots of the first type connectors and the second type connectors.

10. The electronic device of claim 1, wherein the first type connectors are conductive jumpers, and the second type connectors are insulating jumpers.

* * * * *